US005170913A

United States Patent [19]

Spatz

[11] Patent Number: 5,170,913

[45] Date of Patent: Dec. 15, 1992

[54] DISPENSERS FOR FLUENT MASSES WITH ENHANCED SEALING AND LATCHING

[75] Inventor: Walter B. Spatz, Los Angeles, Calif.

[73] Assignee: The Spatz Corporation, Oxnard, Calif.

[21] Appl. No.: 788,047

[22] Filed: Nov. 4, 1991

Related U.S. Application Data

[63] Continuation-in-part of Ser. No. 689,176, Apr. 22, 1991, abandoned.

[51] Int. Cl.[5] ..... B65D 37/00

[52] U.S. Cl. ..... 222/209; 222/215; 222/386; 222/391

[58] Field of Search ..... 222/206, 209, 212, 213, 222/215, 386, 387, 391, 92, 107

[56] References Cited

U.S. PATENT DOCUMENTS

| | | | |
|---|---|---|---|
| 2,847,009 | 8/1958 | Blease | 222/386 X |
| 3,211,347 | 10/1965 | Phillips, Jr. | 222/386 X |
| 3,768,705 | 10/1973 | Spatz | 222/213 |
| 3,870,200 | 3/1975 | Spatz | 222/386 X |
| 4,269,330 | 5/1981 | Johnson | 222/386 |
| 4,308,977 | 1/1982 | Sigmund et al. | 222/386 X |
| 4,949,873 | 8/1990 | Maeder | 222/386 X |

FOREIGN PATENT DOCUMENTS

| | | | |
|---|---|---|---|
| 848547 | 9/1960 | United Kingdom | 222/213 |

*Primary Examiner*—Kevin P. Shaver
*Attorney, Agent, or Firm*—Lewis B. Sternfels

[57] ABSTRACT

A container (12) includes a discharge outlet (18) and a pliant tubular wall (16) which extends longitudinally from the outlet. The wall of the container is adapted to be deformed by being squeezed for dispensing a mass (24) from the container through the outlet. A piston follower (26, 126) in the container, which is movable towards the outlet and against the mass, has seals (60, 61; 160, 162) that slide on, yet remain sealed with the wall to prevent both leakage of the mass past the seals out of the container and leakage of air past the seals into the container. Degradation in the sealing engagemenet of the seals with the container wall, when the wall is squeezed, even under excessive force, is essentially prevented by a rigid support (72), which is embodied as a ring (138) or radially and longitudinally extending webs (42) acting as struts. The rigid support ensures that the seals will not lose contact with the inner wall surface (17) of container (12). Latches (50, 150) on the follower prevent substantially all movement of the follower in a direction away from the outlet but permit movement of the follower in a direction toward the outlet. The latches are sufficiently distanced from the seals so that neither the deflectability of the latches nor the sealing of the seals is degraded.

23 Claims, 2 Drawing Sheets

Fig. 6.
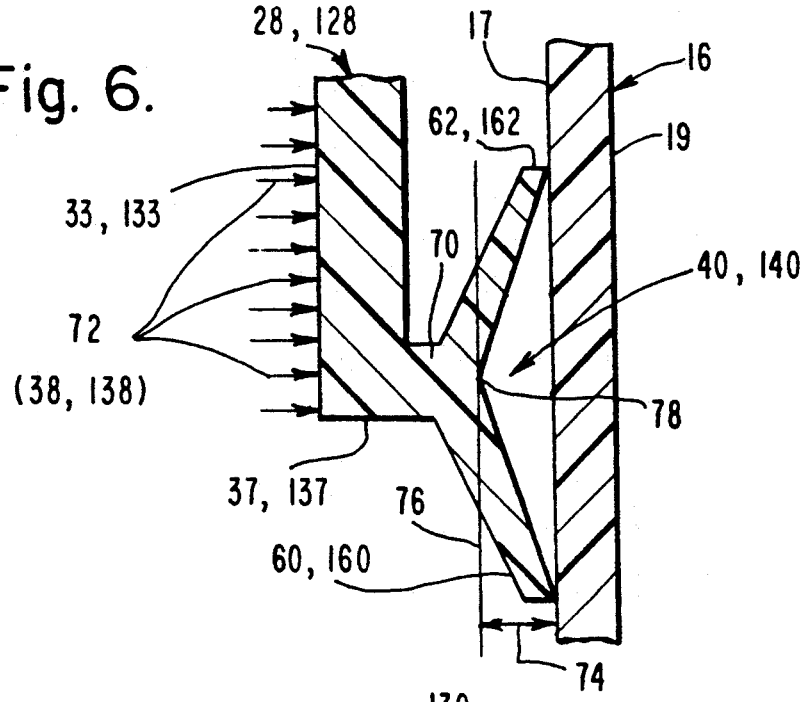
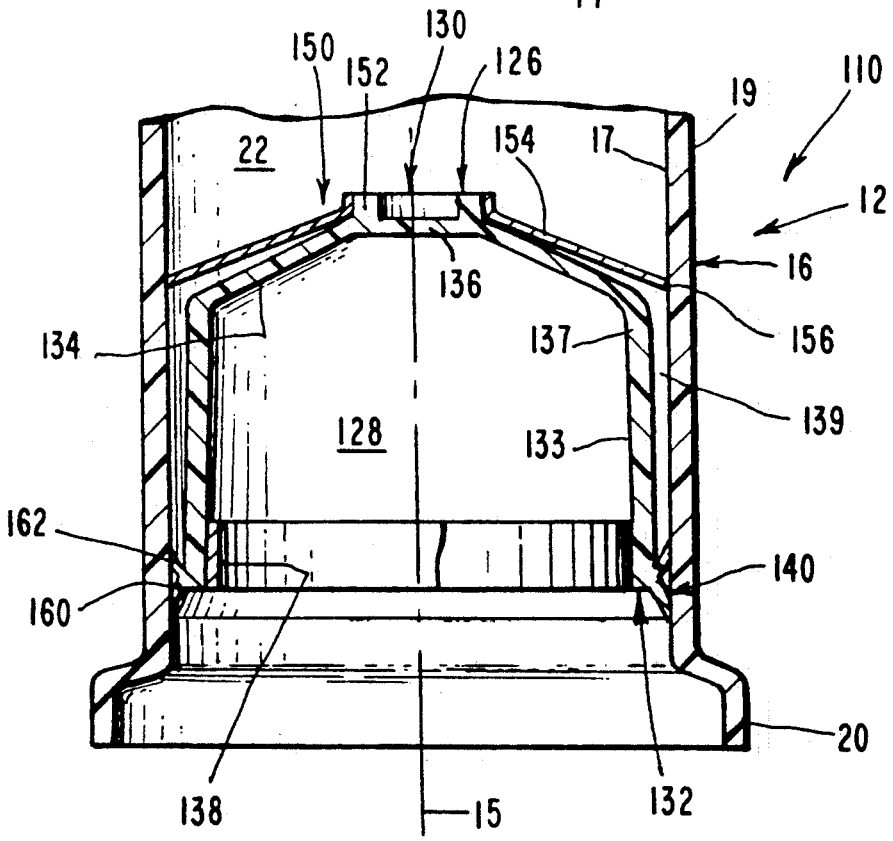
Fig. 5.

DISPENSERS FOR FLUENT MASSES WITH ENHANCED SEALING AND LATCHING

This is a continuation-in-part of Ser. No. 07/689,176 filed Apr. 22, 1991, now abandoned.

FIELD OF THE INVENTION

The present invention relates to dispensers for fluent masses and, more particularly, to such dispensers having improved sealing and latching.

BACKGROUND OF THE INVENTION

In my Pat. No. 3,768,705 there is described a pliant, elastic container for toothpaste, cream, or other fluent materials, which has a forward outlet or discharge portion and a one-way follower or piston in the container. The follower is disposed at the rear of the fluent material and sealingly engages the container wall, and is automatically moved by ambient air pressure toward the outlet after each dispensing of the material. The follower is arranged to grip and latch onto the container wall to prevent its movement way from the outlet of the container. Dispensing of the material occurs as a result of squeezing or deflecting the container at any point, including the region forwardly of the follower, directly at the location of the follower, the region rearwardly of the follower, and at the discharge portion of the container.

My Pat. No. 3,870,200 discloses a similar dispenser of fluent materials but does not rely upon the squeezing of the pliant walls of the container to discharge the fluent material as provided by Pat. No. 3,768,705. Rather, it utilizes a hollow head or dome of pliant, elastic material which is positioned at the end of the container opposite from its one-way follower and which incorporates a central discharge nozzle. A deforming force exerted on the hollow head or dome discharges the fluent material through the nozzle. Release of the deforming force on the head or dome, or other parts of the container, and the return of the head or other container part to its initial shape has the effect of producing a subatmospheric pressure or vacuum within the container in advance of the one-way follower or piston, and enables the follower to move towards the discharge nozzle.

In Pat. No. 3,870,200 the follower or oiston includes a main body having a central hub and an outer rim, with intervening stiffener ribs interconnecting the two parts for relative rigidity.

In both Pat. Nos. 3,768,705 and 3,870,200 the sealing of the follower with the container wall is provided by a pair of grip seals. One seal points toward the outlet of the container and prevents material from being forced out of the rear of the container when the container is squeezed. The other seal points toward the rear of the container and prevents air from entering the container after the container has been squeezed.

The dispensers described in Pat. Nos. 3,768,705 and 3,870,200 work well. However, if the container in either dispenser were squeezed with excessive force, the seals would lose their ability to seal and, therefore, material would be extruded rearwardly out of the container or air would be sucked into the container. Specifically, there are two circular sealing contacts between the lips of the two seals and the inner surface of the container before the container is squeezed. Analysis indicates that, under excessive force, the sealing between the lips and the container's inner surface portion will not maintain congruency because the lips are inadequately supported, and the sealing will fail. Although Pat. No. 3,870,200 discloses intervening stiffener ribs, these ribs do not provide the necessary support to prevent such sealing failure.

SUMMARY OF THE INVENTION

These and other matters are successfully addressed and overcome by the present invention by ensuring that the sealing contact between the seals and the container is maintained during even strenuous squeezing of the container.

Specifically, like the dispenser disclosed in Pat. No. 3,768,705, the dispenser of the present invention comprises a container having a discharge outlet and a pliant and elastic tubular wall which extends longitudinally from the outlet. A piston follower in the container, which is movable toward the outlet and against the fluent material, has seals that can slide on, yet remain sealed with the wall to prevent leakage of the fluent material past the seals out of the container and leakage of air past the seals into the container. Latches on the follower prevent substantially all movement of the follower in a direction away from the outlet but permit movement of the follower in a direction toward the outlet.

Unlike the dispensers of Pat. Nos. 3,768,705 and also 3,870,200, degradation in the sealing engagement of the seals with the container wall, when the wall is squeezed, is avoided by providing the follower with a rigid support for the seals, while longitudinally spacing the latches from the seals. Only the seals are permitted to flex, while their attachment to and support by the follower is made substantially rigid and inflexible. If the follower itself does not have the necessary rigidity, additional support may be provided. Thus, the follower is made relatively rigid vis-a-vis the seals.

If desired, the wall of the container may have an increasing thickness as the wall extends away from the dispensing end of the container, thereby increasing its rigidity from its dispensing end towards its closed end, so that the follower is always positioned at a thicker portion of the wall. Thus, the container wall is relatively more rigid where the wall contacts the seals than at the wall portions near the outlet. This feature encourages a user to squeeze or deform the container near its outlet where the fluent material is to be dispensed, rather than at the seals, further to avoid deleterious lessening of the sealing contact.

The latching is also improved by providing a means by which bending in the latches beyond their elastic yield point is prevented and by spacing the latches from the seals a sufficient distance so as to prevent degradation in sealing.

Several advantages are derived from this arrangement. Primarily, sealing between the seals and the wall of the container is maintained despite even strenuous squeezing of the container. The ability of the latches to latch is enhanced, while not deleteriously affecting the sealing.

Other aims and advantages, as well as a more complete understanding of the present invention, will appear from the following explanation of exemplary embodiments and the accompanying drawings thereof.

BRIEF DESCRIPTION OF THE DRAWINGS

FIG. 5 is a partial view, similar to that shown in FIG. 2, but illustrating a modified enhanced sealing construction; and FIG. 6 is an enlarged view of a section of the seal and its rigid support for use in the illustrative dispensers described herein.

DETAILED DESCRIPTION OF THE PREFERRED EMBODIMENTS

Figures 1, 2, 3, 4:
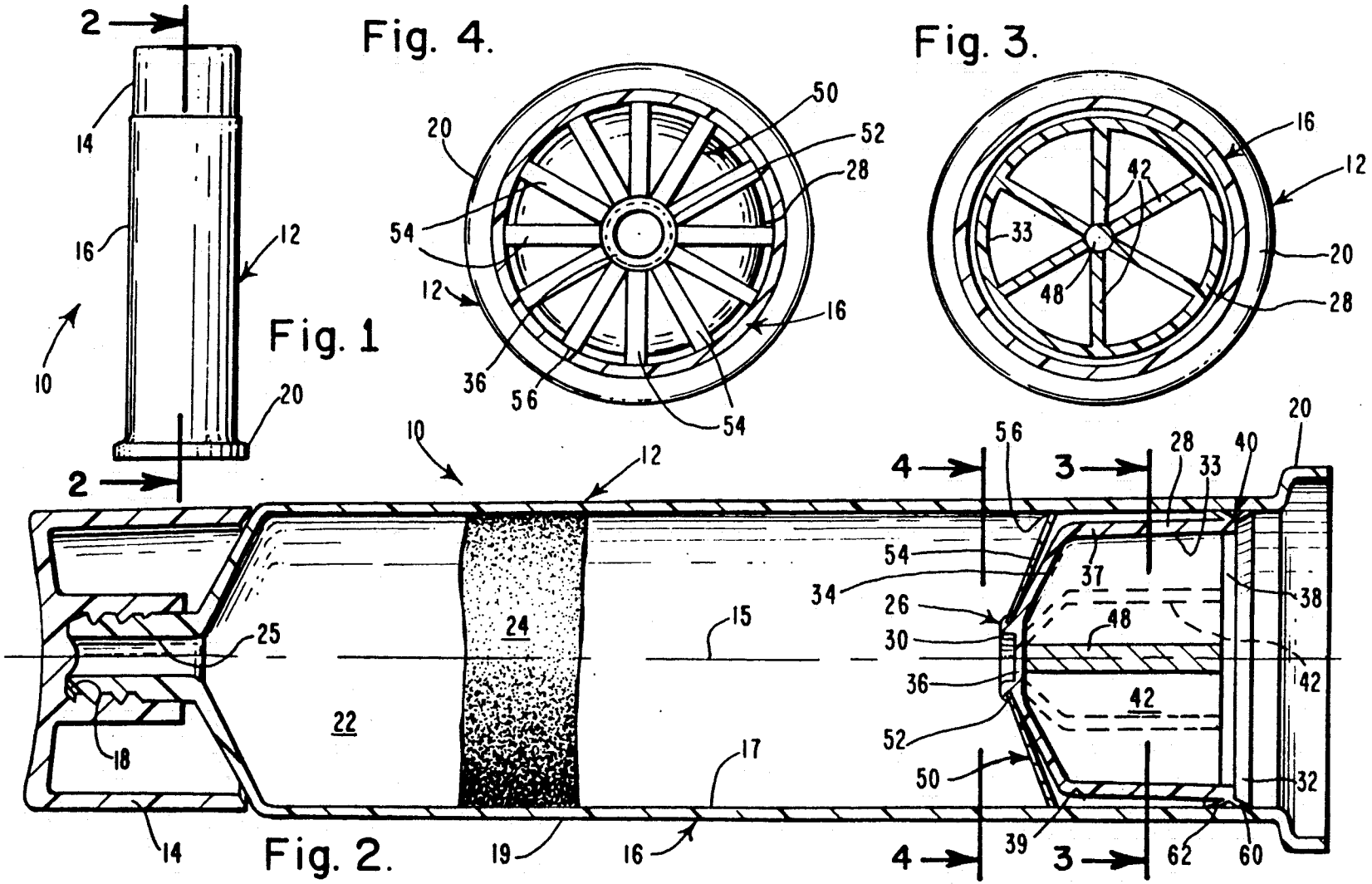
FIG. 1 is a view in elevation of a dispenser configured in accordance with the concepts of the present invention.
FIG. 2 is a cross-sectional view of the dispenser shown in FIG. 1 taken along line 2—2 thereof illustrating enhanced sealing and latching for the follower or piston.
FIG. 3 is a cross-sectional view of the dispenser taken along line 3—3 of FIG. 2.
FIG. 4 is a cross-sectional view of the dispenser taken along line 4—4 of FIG. 2.

As shown generally in FIG. 1 and in both embodiments depicted in FIGS. 2 and 5, dispensers 10 and 110 include a container 12 and a cap 14, centered generally about a longitudinally extending axis 15. As best illustrated in FIG. 2, but with equivalency for the FIG. 5 embodiment, container 12 includes a tubular wall 16 having an outlet or nozzle 18 at one end and an open portion 20 at the end opposed from outlet 18. Wall 16 is thin and flexible so as to be easily squeezed, and its cross section is decreased in thickness in a direction extending from open portion 20 to outlet 18, to increase the pliability of wall 16 as it approaches the outlet. The decrease in thickness is obtained by providing wall 16 with an inner surface 17 which is cylindrical and an outer wall surface 19 which is slightly conical. A cylindrical interior 22 contains a mass 24 for toothpaste, cream or other fluent materials. As is typical in such constructions, mass or material 24 is disposed to be extruded through a discharge portion 25 which extends through outlet 18. During times of non-use of dispenser 10, cap 14 threadedly engages the outlet to prevent discharge of material 24.

As depicted in FIGS. 2 and 5, interior 22 of container 12 is closed off at open portion 20 by one-way followers or pistons 26 and 126. Followers 26 and 126 respectively comprise rigid cup-shaped bodies 28 and 128 having forward ends 30 and 130 facing outlet 18 and rearward ends 32 and 132 facing open portion 20 of container 12. Forward ends 30 and 130 are respectively closed by forward transverse walls 34 and 134 which terminate in central hubs 36 and 136 and generally longitudinally-extending tubular walls 37 and 137 having inner surfaces 33 and 133. As shown, each of these longitudinally-extending walls and container wall 16 are closely positioned together and provide spaces 39 and 139 which are small relative to the diameter of container 12. Bodies 28 and 128 respectively terminate in peripheral annular sealing arrangements 40 and 140 at their ends opposite from walls 34 and 134. Sealing arrangements 40 and 140 include respective pairs of oppositely extending annularly disposed seals 60 and 62 and seals 160 and 162.

Rigid supports 38 and 138 are provided for sealing arrangements 40 and 140, and may be of any desired configuration. However, as will be explained more fully with respect to FIG. 6, a rigid support, regardless of its specific construction, must provide an essentially inflexible support against radially exerted forces for its sealing arrangement.

In a first of the two embodiments, which is illustrated in FIGS. 2 and 3 as an example of the present invention, rigid support 38 comprises, as also shown in FIG. 3, webs 42 which longitudinally extend between forward end 30 (where they are integral with wall 34) and rearward end 32 and radially extend from one side of inner surface 33 of body 28 to a central hub 48. Webs 42 therefore have the appearance of panels and operate as struts to support the annular disposition of sealing arrangement 40 against inner surface 17 of tubular wall 16.

In a second of the two embodiments, which is depicted in FIG. 5 as another example of the present invention, rigid support 138 comprises a solid, essentially inflexible ring of any suitable material. For illustrative purposes, rigid support or ring 138 is formed of metal. Support or ring 138 is pressed, bonded or otherwise properly affixed to inner surface 133 within body 128, or body 128 may be molded over the support or ring.

As shown also in FIG. 4, a one-way gripper or latch device 50 (which is identified as a one-way gripper or latch device 150 in FIG. 5) is respectively positioned between sealing arrangements 40 and 140 and outlet 18. Latch devices 50 and 150, which form respective parts of followers 26 and 126, include central portions 52 and 152 which are heat-swaged, press-fitted or otherwise captured about the periphery of central portions or hubs 36 and 136. A plurality of flexible, radial fingers 54 and 154 extend in a generally radial direction outwardly from central portions 52 and 152 toward and into engagement with wall 16, and are adapted to latch onto inner surface 17 of wall 16. Fingers 54 and 154 also extend rearwardly toward open portion 20 and have a slope which is slightly different from that of forward transverse walls 34 and 134 of rigid bodies 28 and 128. Fingers 54 and 154 are so arranged as to be capable of deflecting about central portions 52 and 152 and hubs 36 and 136 as latch devices 50 and 150 are inserted in container 12 through its open portion 20, to assume the illustrated inclined positions, that is, in a transverse and rearward direction, and with their outer ends 56 and 156 engaging inner surface 17 of wall 16. The arrangement is such that fingers 54 and 154 slide along inner surface 17 when followers 26 and 126 move or advance in a forward direction within container 12 towards outlet 18. However, any tendency of either follower to move rearwardly in the container causes outer ends 56 and 156 of fingers 54 and 154 to grip or latch against inner surface 17 of wall 16.

As depicted in FIGS. 2 and 5, sealing arrangements 40 and 140 includes pairs of annularly disposed seals 60 and 62 and seals 160 and 162, with seals 60 and 160 extending rearwardly toward open end 20 of the container and seals 62 and 162 extending forwardly toward outlet 18 of the container. These seals act respectively to prevent air from being sucked into interior 22 of the container and to prevent extrusion of mass or material 24 out of the container through open portion 20. In order to prevent the seals from losing their sealing engagement with inner surface 17 of wall 16, they are supported by rigid webs 42 and support ring 38 or the equivalent. Therefore, the combination of rigid body 28 with webs 42 and rigid body 128 with ring 38 prevents even undue squeezing of walls 16 from unsealing either sealing arrangement 40 or 140 from wall 16.

For the FIG. 2 embodiment, webs 42 act as struts essentially to prevent radial deformation of container 12 and any deflection of wall 16 adjacent sealing arrangement 40; thus ensuring that seals 60 and 62 will remain in their sealing contact with inner surface 17.

In a like manner, for the FIG. 5 embodiment, ring 138 acts as an essentially inflexible or unyieldable support to prevent radial deformation of container 12 and any deflection of wall 16 adjacent sealing arrangement 140; thus ensuring that seals 160 and 162 will remain in their sealing contact with inner surface 17.

Reference is now made to FIG. 6, which is an enlarged view of a sealing arrangement, such as of sealing arrangements 40 and 140, and a rigid support therefor. As disclosed therein, seals 60 and 160 and seals 62 and 162 are secured to tubular walls 37 and 137 of rigid bodies 28 and 128 by a connection 70. To ensure that the sealing between seals 60 and 160 and seals 62 and 162 with inner surface 17 of tubular wall 16 is not degraded, it is advantageous that only seals 60 and 160 and seals 62 and 162 be allowed to flex, and that walls 37 and 137 of rigid bodies 28 and 128 and connection 70 not be permitted to flex. If bodies 28 and 128 and connection 70 do not provide the necessary rigidity, an additional support, generally designated by arrows 72 is positioned at inner surfaces 33 and 133 of body walls 37 and 137. As disclosed herein, such rigidity is provided by such supports as webs 42 and ring 138. It is to be understood, however, that any other suitable rigidifying means or method may be employed, and that the particular elements disclosed herein are illustrative of the present invention.

Therefore, the rigidity provided by bodies 28 and 128 and connection 70, alone or aided by support 72, ensures that only seals 60 and 160 and seals 62 and 162 will have sufficient flexibility to maintain a sealing contact with inner surface 17 of tubular wall 16. This flexibility of the seals is limited to an extent generally denoted by the space designated by double headed arrow 74, which lies between inner wall surface 17 and a line 76 generally passing through an apex 78 where seals 60 and 160 and seals 62 and 162 intersect. It is to be further understood that line 76 is shown only for illustrative purposes, and that the flexibility of the seals may somewhat vary from what is depicted as line 76.

Because deflection of wall 16 is greatly inhibited at or essentially close to seals 60 and 62 and seals 160 and 162, it is mandatory that latch devices 50 and 150 and, in particular, flexible fingers 54 and 154 and their engagement with inner surface 17, be axially spaced, i.e., separated, from sealing arrangement 40 and 140. This axial separation is needed to permit free actuation of flexible fingers 54 and 154, while preventing degradation of the sealing. For example, a separation which is at least ½ the diameter of sealing arrangements 40 and 140 should provide the desired protection.

In operation, squeezing of container 12 causes fluent material 24 to exit from dispenser 10 through outlet 18; however, the time at which one-way followers 26 and 126 move is dependent upon where the squeezing occurs. If the squeezing is at or near latch devices 50 and 150, purely mechanical action immediately forces one-way followers 26 and 126 towards outlet 18. If the container is squeezed between latch devices 50 and 150 and outlet 18, there is no immediate movement of followers 26 and 126 but, when the squeezing pressure is released, the partial vacuum generated by recovery of the container allows atmospheric pressure behind followers 26 and 126 to drive it towards outlet 18. Although these two distinct modes of operation can occur separately or jointly when most of the fluent material is contained in dispenser 10, when its contents are nearly used up, only the former mode is operable.

In the foregoing description of the present invention, it has been assumed that fluent material 24 has a viscosity which is sufficiently high vis-a-vis the opening size of discharge portion 25 of outlet 18 to produce a combined impediment to flow of the fluent material from outlet 18, in the same manner as is described in Pat. No. 3,870,200. However, if the viscosity is insufficiently high, a check valve, such as is described in above-mentioned Pat. No. 3,768,705, can be used.

Although the invention has been described with respect to particular embodiments thereof, it should be realized that various changes and modifications may be made therein without departing the spirit and scope of the invention.

What is claimed is:

1. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet;

piston follower means in said container movable towards said outlet and against the mass in said container, said follower means having seal means having a sliadable and sealing engagement with said wall, and a ring secured to and positioned under said seal means for rigidly supporting said seal means and thereby for essentially preventing any degradation in the sealing engagement of said seal means with said wall when said wall is squeezed.

2. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet; and piston follower means in said container movable towards said outlet and against the mass in said container, said follower means having seal means having a sliadable and sealing engagement with said wall for preventing leakage of the mass past said seal means from said container and leakage of said past said seal means into said container, one-way latch means engageable with said wall for prevention substantially all movement of said follower means in a direction away from said outlet while permitting movement of said follower means in a direction toward said outlet, and means longitudinally spacing said seal means from said latch means including generally horizontally extending tubular walls secured at a first end thereof to said seal means and at a second end to said latch means, said tubular walls providing an axial separation between said seal means and said latch means sufficient to prevent actuation of said latch means from degrading the sealing engagement of said seal means with said wall when said wall is squeezed.

3. A dispenser for a fluent mass comprising:

a container having a discharge outlet and a pliant tubular wall which extends longitudinally from said outlet, which encloses the mass and which is adapted to e deformed by being squeezed for enabling the mass to be dispensed through said outlet; and piston follower means in said container movable towards said outlet and against the mass in said container, said follower means having seal means having a sliadable and sealing engagement a with said wall for preventing leakage of the mass past said seal means form said confiner and leakage of air past said seal means into said container, one-way latch means engageably with said wall for preventing substantially all movement of said follower means is a direction away from said outlet while permitting movement of said follower means in a direction toward said outlet, means secured to and fully supporting said seal means for essentially preventing deflection thereof out of the sealing engagement with said wall, and means longitudinally spacing said seal means from aid latch means for essentially preventing any degradation in the sealing engagement of said seal means with said wall when said wall is squeezed.

4. A dispenser according to claim 3 in which said means for essentially preventing deflection of aid seal means comprises a web-shaped support secured to and positioned under said seal means.

5. A dispenser according to claim 3 in which said longitudinally spacing mean comprises a generally longitudinally extending structure secured to said seal means and to said latch means.

6. A dispenser according to claim 5 in which said longitudinally extending structure includes a first end secured to said seal mean and a second end secured to said latch means.

7. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet; and piston follower means in said container movable towards said outlet and against the mass in said container, said follower means having seal means having a slidable and sealing engagement with said wall of preventing leakage of the mass past said seal means from said container and leakage of air past said seal means into said container, one-way latch means engageable with said wall for preventing substantially all movement of said follower means in a direction away from said outlet while permitting movement of said follower mean sin a direction toward said outlet, and means including a longitudinally extending structure having a first end secured to said seal means and a second end secured to said latch means for longitudinally spacing said seal means from said latch means and for essentially preventing any degradation in the sealing engagement of said seal means with said wall when said wall is squeezed, said second end including a generally radially extending support and said latch means including deflectable fingers having first ends which are secured to said support and second ends which diverge away from aid outlet into engagement with said wall and which are closely spaced from said support.

8. A dispenser according to claim 7 in which said fingers are positioned closer to said outlet than said support for enabling said support to prevent deflection of said fingers beyond their elastic limit.

9. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet; and piston follower means in said container movable towards said outlet and against the mass in said container, said follower means having seal means having a sliadable and sealing engagement with said wall for preventing leakage of the mass past said seal means from said container and leakable of air past said seal means into said container, one-way latch means engageable with said wall for preventing substantially all movement of said follower means in a direction away from said outlet while permitting movement of said follower means in a direction toward said outlet, and means including a longitudinally extending structure having a first end secured to said seal means and a second end secured to said latch means for longitudinally spacing said seal means from said latch means and for essentially preventing any degradation in the sealing engagement of aid seal means with said wall when said wall is squeezed, said second end including a support having a central portion and a generally radially extending portion which is sloped away from aid outlet, and said latch means including deflectable fingers having first ends which are secured to said central portion of said support and second ends which slope from said outlet into engagement with said wall and which are closely spaced from said sloped portion of said support, said fingers being positioned closer to said outlet than said support so that said support can prevent deflection of said fingers beyond their elastic limit.

10. A dispenser according to claim 9 in which said longitudinally extending structure further includes generally horizontally extending tubular walls secured at a first end thereof to said sail means and at a second end to said support, said tubular walls providing an axial separation between said seal means and said support for said latch means sufficient to prevent actuation of said latch means from degrading the sealing engagement between said seal means and said tubular wall.

11. A dispenser for a fluent mass comprising:

a container having a discharge outlet and a pliant tubular wall which extends longitudinally from aid outlet, which encloses the mass and which is adapted to be deformed by being squeezed for enabling the mass to be dispensed through said outlet;

piston follower means in said container movable towards said outlet and against the mass in said container, said follower means having seal means having a liable and sealing engagement with said wall, and degradation preventing mean fully supporting said seal means for essentially preventing any degradation in the sealing engagement of said seal means with said wall when said wall is squeezed.

12. A dispenser according to claim 11 in which said degradation preventing mean comprises an essentially inflexible support for supporting said sail means.

13. A dispenser according to claim 11 in which said wall has a thickness which increases in cross-section in a direction extending longitudinally from said outlet and at least towards said follower.

14. A dispenser according to claim 11 wherein:

said tubular wall is centered about an axis and terminates an open portion at a end opposite from said discharge outlet;

said follower means comprises a rigid body having a forward end facing said container outlet and a rearward end facing said open portion of said tubular wall, said forward end being closed by a transverse wall terminating in a central hub; and said degradation minimizing means comprises webs extending longitudinally between said forward and rearward ends and radially inwardly from said seal means to said transverse wall, and secured together at said hub for rigidly supporting said seal means and, thereby, for maintaining said sealing engagement even during excessive squeezing of said tubular wall.

15. A dispenser according to claim 11 in which said degradation preventing means comprises means for rigidly supporting said seal means.

16. A dispenser according to claim 15 in which said supporting means comprises a web-shaped support secured to and positioned under said seal means.

17. A dispenser according to claim 11 further including movement preventing means for preventing substantially all movement of said follower means in a direction away from said outlet while permitting movement of said follower means in a direction toward said outlet.

18. A dispenser according to claim 17 in which said movement preventing means comprises means latchable with said wall, said preventing means being longitudinally spaced in said container from said degradation presenting means and being positioned closer to said outlet than said degradation preventing means.

19. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet;

piston follower means in said container movable towards said outlet and against the mass in said container, said follower means having seal means having a slidable and sealing engagement with said wall, and means for minimizing any degradation in he sealing engagement of said seal means with said wall when aid wall is squeezed, said wall having a thickness which increases in cross-section i a direction extending longitudinally from said outlet and at least towards said follower means.

20. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet; and piston follower means in said container movable towards said outlet and against the mass in said container, said follower means having seal means having a slidable and sealing engagement with said wall for preventing leakage of the mass past said seal means from said container and leakage of air past said seal means into said container, one-way latch means engageable with said wall for preventing substantially all movement of said follower means in a direction away from said outlet while permitting movement of said follower means in a direction toward said outlet, and means for longitudinally spacing said seal means from said latch means for minimizing any degradation in the sealing engagement of said seal means with said wall when said wall is squeezed, said longitudinally spacing means including a generally longitudinally extending structure secured to said seal means and to said latch means, said longitudinally extending structure including a first end secured to said seal means and a second end secured to said latch means, said second end including a generally radially extending support and said latch means including deflectable fingers having first ends which are secured to said support and second ends which diverge away from said outlet into engagement with said wall and which are closely spaced from said support.

21. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet; and piston follower means in said container movable towards said outlet and against the mass in said container, said follower means having seal means having a slidable and sealing engagement with said wall for preventing leakage of the mass past said seal means from said container and leakage of air past said seal means into said container, one-way latch means engageable with said wall for preventing substantially all movement of said follower means in a direction away from said outlet while permitting movement of said follower means in a direction toward said outlet, and means for longitudinally spacing said seal means from said latch means for minimizing any degradation in the sealing engagement of said seal means with said wall when said wall is squeezed, said longitudinally spacing means including a generally longitudinally extending structure secured to said seal means and to said latch means, said longitudinally extending structure includes a first end secured to said seal means and a second end secured to said latch means, said second end including a support having a central portion and a generally radially extending portion which is sloped away from said outlet; and said latch means including deflectable fingers having first ends which are secured to said central portion of said support and second ends which slope from said outlet into engagement with said wall and which are closely spaced from said sloped portion of said support, said fingers being positioned closer to said outlet than said support so that said support can prevent deflection of said fingers beyond their elastic limit.

22. A dispenser for a fluent mass comprising:

a container having a discharge outlet and a pliant tubular wall which extends longitudinally from said outlet, which encloses the mass and which is adapted to be deformed by being squeezed for enabling the mass to be dispensed through said outlet;

piston follower means in said container movable towards said outlet and against the mass in said container, said follower means having seal means having a slidable and sealing engagement with said wall, and means for minimizing any degradation in the sealing engagement of said seal means with said wall when said wall is squeezed; and means for preventing substantially all movement of said follower means in a direction away from said outlet while permitting movement of said follower means in a direction toward said outlet, said preventing means including means latchable with said wall, and being longitudinally spaced in said container from said degradation minimizing means and positioned closer to said outlet than said degradation minimizing means.

23. A dispenser for a fluent mass comprising:

a container having a discharge outlet and a pliant tubular wall which extends longitudinally from said outlet, which is centered about an axis, which terminates in an open portion at an end opposite from said discharge outlet, which encloses the mass and which is adapted to be deformed by being squeezed for enabling the mass to be dispensed through said outlet; and piston follower means in said container movable towards said outlet and against the mass in said container, said follower means including a rigid body having a forward end facing said container outlet and a rearward end facing said open portion of said tubular wall, said forward end being closed by a transverse wall terminating in a central hub, seal means having a slidable and sealing engagement with said wall, and means for minimizing any degradation in the sealing engagement of said seal means with said wall when said wall is squeezed, said degradation minimizing means including webs extending longitudinally between said forward and rearward ends and radially inwardly from said seal means to said transverse wall, and secured together at said hub for rigidly supporting said seal means and, thereby, for maintaining said sealing engagement even during excessive squeezing of said tubular wall.

* * * * *